US011553755B2

(12) United States Patent
Yahata et al.

(10) Patent No.: US 11,553,755 B2
(45) Date of Patent: Jan. 17, 2023

(54) SOLE STRUCTURE FOR A SHOE

(71) Applicant: Mizuno Corporation, Osaka (JP)

(72) Inventors: Kentaro Yahata, Osaka (JP); Hiroshi Inohara, Toyonaka (JP); Shogo Matsui, Osaka (JP); Shin Hirai, Himeji (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 16/820,987

(22) Filed: Mar. 17, 2020

(65) Prior Publication Data

US 2020/0305541 A1 Oct. 1, 2020

(30) Foreign Application Priority Data

Mar. 31, 2019 (JP) ..... JP2019-069539

(51) Int. Cl.
*A43B 7/1455* (2022.01)
*A43B 13/18* (2006.01)
(Continued)

(52) U.S. Cl.
CPC ..... *A43B 7/146* (2013.01); *A43B 7/1445* (2013.01); *A43B 13/023* (2013.01); *A43B 13/125* (2013.01); *A43B 13/184* (2013.01)

(58) Field of Classification Search
CPC ..... A43B 7/146; A43B 13/122; A43B 13/125; A43B 13/184; A43B 13/188;
(Continued)

(56) References Cited

U.S. PATENT DOCUMENTS 4,733,483 A * 3/1988 Lin ..... A43B 17/02 36/28
2007/0113424 A1* 5/2007 Bell ..... A43B 13/122 36/7.6

(Continued)

FOREIGN PATENT DOCUMENTS

GB 2145321 A * 3/1985 ..... A43B 7/06
JP 06-70801 A 3/1994

(Continued)

OTHER PUBLICATIONS

Japanese Office Action dated Feb. 2, 2021 in Japanese Patent Application No. 2019-069539, 4 pages, with English partial translation, 5 pages.

*Primary Examiner* — Sharon M Prange
*Assistant Examiner* — Grady Alexander Nunnery
(74) *Attorney, Agent, or Firm* — Cantor Colburn LLP

(57) ABSTRACT

A sole structure for a shoe that can secure cushioning properties and obtain a ground surface information is disclosed. The sole structure includes a first midsole having a plurality of first protrusions on a foot-sole-contact side, an outsole having a plurality of second protrusions on a ground surface side, and a second midsole disposed at a part of a region between the first midsole and the outsole and having a lower compressive rigidity than the first midsole. At least a part of the plurality of first protrusions of the first midsole is located at a position corresponding vertically to at least a part of the plurality of second protrusions of the outsole.

12 Claims, 21 Drawing Sheets

(51) Int. Cl.
*A43B 13/12* (2006.01)
*A43B 7/1445* (2022.01)
*A43B 13/02* (2022.01)

(58) Field of Classification Search
CPC ..... A43B 13/223; A43B 13/226; A43B 7/148; A43B 5/02; A43B 13/26; A43B 17/00; A43B 13/12; A43B 13/127
USPC ..... 36/141
See application file for complete search history.

(56) References Cited

U.S. PATENT DOCUMENTS

2007/0169376 A1* 7/2007 Hatfield ..... A43B 13/125 36/29
2008/0229617 A1* 9/2008 Johnson ..... A43B 3/0057 36/102
2010/0126043 A1 5/2010 Loverin et al.
2010/0307025 A1* 12/2010 Truelsen ..... A43B 5/06 36/28
2011/0239489 A1* 10/2011 Iuchi ..... A43B 13/12 36/30 R
2013/0104419 A1 5/2013 Horesh et al.
2014/0109444 A1* 4/2014 Dumont ..... A43B 13/184 36/25 R
2016/0051012 A1* 2/2016 Avar ..... A43B 13/127 36/103
2017/0127756 A1* 5/2017 LaFortune ..... A43B 13/12
2017/0340058 A1 11/2017 Madore
2017/0340062 A1 11/2017 Qin
2018/0303197 A1* 10/2018 Chen ..... A43B 13/141

FOREIGN PATENT DOCUMENTS

JP 2015-077475 A 4/2015
JP 3213557 U 10/2017
JP 3213706 U 11/2017

* cited by examiner

SOLE STRUCTURE FOR A SHOE

BACKGROUND OF THE INVENTION

The present invention relates generally to a sole structure for a shoe, and more particularly, to an improvement in the sole structure so as to secure cushioning properties and obtain a ground surface information.

US patent application publication No. 2010/0126043 discloses a sole structure for a shoe that has a plurality of ground contact pads provided at a forefoot region of the sole so that forces incurred at the ground contact pads can be feedbacked to a foot of a wearer (especially, infant) (see para. [0057] and FIGS. 2-4, 11 and 24).

However, in the above-mentioned structure, the ground contact pads are not provided at a rearfoot region of the sole. Therefore, in the rearfoot region, a ground surface information cannot be feedbacked to the wearer. On the other hand, in the event that the rearfoot region is formed of a material having a high settling resistance because the rearfoot region experiences a greater load than a forefoot region, it is considered that cushioning properties and a touch on foot are lessened.

The present invention has been made in view of these circumstances and its object is to provide a sole structure for a shoe that can secure cushioning properties and obtain a ground surface information. Also, the present invention is directed to providing a sole structure for a shoe that can increase settling resistance and allow for a maintenance of cushioning properties and a feedback of a ground surface information. Moreover, the present invention is directed to providing a sole structure for a shoe that can achieve a feedback of a ground surface information and a maintenance of cushioning properties for a prolonged period of time.

Other objects and advantages of the present invention will be obvious and appear hereinafter.

SUMMARY OF THE INVENTION

A sole structure for a shoe according to the present invention includes a first midsole that has a plurality of first protrusions on a foot-sole-contact side, an outsole that has a plurality of second protrusions on a ground surface side, and a second midsole that is disposed at apart of a region between the first midsole and the outsole and that has a compressive rigidity lower than a compressive rigidity of the first midsole. At least a part of a plurality of first protrusions of the first midsole is located at a position corresponding vertically to at least a part of a plurality of second protrusions of the outsole.

According to the present invention, when the second protrusions of the outsole come into contact with the ground at the time of impacting the ground, a ground surface information such as the size and direction of the ground reaction force acting from the ground to the second protrusions, angularities of the ground surface and the like are transmitted to the first protrusions of the first midsole disposed at a position corresponding vertically to the second protrusions of the outsole, and then transmitted to a foot sole of a shoe wearer from the first protrusions. Thereby, the ground surface information is feedbacked to the foot sole of the wearer.

At this juncture, since the second midsole having a lower compressive rigidity than the first midsole is disposed at a part of a region between the first midsole and the outsole, such a region has high cushioning properties. Therefore, at a region where the ground surface information is transmitted from the outsole to the first midsole through the second midsole, even in the case that the first protrusions of the first midsole is formed of a material having a high settling resistance, cushioning properties can be increased, and a feedback of the ground surface information and a maintenance of cushioning properties can be achieved for a prolonged period of time.

The first midsole may extend from a heel region to a forefoot region and the first protrusions may be provided from the heel region to the forefoot region. In this case, from the heel region to the forefoot region, that is, at a region extending from a rearfoot region to the forefoot region, the ground surface information can be obtained.

The second midsole may have a planar sheet portion at apart of the region between the first midsole and the outsole.

The second midsole may have an upraised portion that rises from a circumferential portion of the planar sheet portion and that extends encompassing a circumferential portion of the first midsole.

The first midsole and the outsole may contact with each other indirectly through the second midsole at a part of the region between the first midsole and the outsole. The first midsole and the outsole may contact directly with each other at an area other than apart of the region between the first midsole and the outsole.

In this case, at such a part of the region between the first midsole and the outsole, the ground surface information can be obtained maintaining cushioning properties, whereas at such an area other than a part of the region between the first midsole and the outsole, the ground surface information can be directly transmitted from the outsole.

The first midsole may have a thin-plate-like base portion of a uniform thickness. A plurality of first protrusions may be separated from each other and protrude from a base surface of the base portion.

A plurality of first protrusions adjacent each other on the base surface may be divided by a plurality of grooves intersecting each other and each having the base surface as its bottom surface.

The second midsole may be disposed at a region from the heel region to a midfoot region. In this case, the ground surface information can be attained from the heel region to the midfoot region maintaining cushioning properties.

The second midsole may be disposed at the forefoot region. Thereby, the ground surface information can be attained at the forefoot region maintaining cushioning properties.

The second midsole may be disposed at a region of the sole structure that corresponds to a thenar eminence, i.e. a distal portion of a first metatarsal of a foot of a person wearing a shoe that has the sole structure. Thereby, the ground surface information can be attained at the thenar eminence maintaining cushioning properties.

The second midsole may be disposed at a region that corresponds to a fifth metatarsal of the foot. Thereby, the ground surface information can be attained at such a region corresponding to the fifth metatarsal maintaining cushioning properties.

The first midsole and the outsole may be disposed at the midfoot region. A hard plate may be provided between the first midsole and the outsole at the midfoot region. In this case, bending rigidity can be enhanced at the midfoot region by the hard plate.

As explained above, in accordance with the present invention, the sole structure comprises a first midsole having a plurality of first protrusions on the foot-sole-contact side, an outsole having a plurality of second protrusions on the ground surface side, and a second midsole disposed at a part of the region between the first midsole and the outsole and having a compressive rigidity less than a compressive rigidity of the first midsole. Also, at least a part of a plurality of first protrusions of the first midsole is located at a position corresponding vertically to at least a part of a plurality of second protrusions of the outsole. Thereby, at such a region where the ground surface information is transmitted from the outsole to the first midsole through the second midsole, cushioning properties can be increased, and a feedback of the ground surface information and a maintenance of cushioning properties can be achieved for a prolonged period of time.

BRIEF DESCRIPTION OF THE DRAWINGS

For a more complete understanding of the invention, reference should be made to the embodiments illustrated in greater detail in the accompanying drawings and described below by way of examples of the invention.

DETAILED DESCRIPTION OF THE PREFERRED EMBODIMENTS

The present invention will now be described in detail with reference to embodiments thereof as illustrated in the accompanying drawings. First, we will explain an entire structure of a sole structure for a shoe according to the present invention. Next, a first to sixth embodiment will be explained. Here, a training shoe is taken for an example, which is used for running, training, etc. in a fitness club and the like.

In the following explanation, "upward (upper side/upper)" and "downward (lower side/lower)" designate an upward direction and a downward direction, or vertical direction, of the shoe, respectively, "forward (front side/front)" and "rearward (rear side/rear)" designate a forward direction and a rearward direction, or longitudinal direction, of the shoe, respectively, and "a width or lateral direction" designates a crosswise direction of the shoe.

Figure 1:
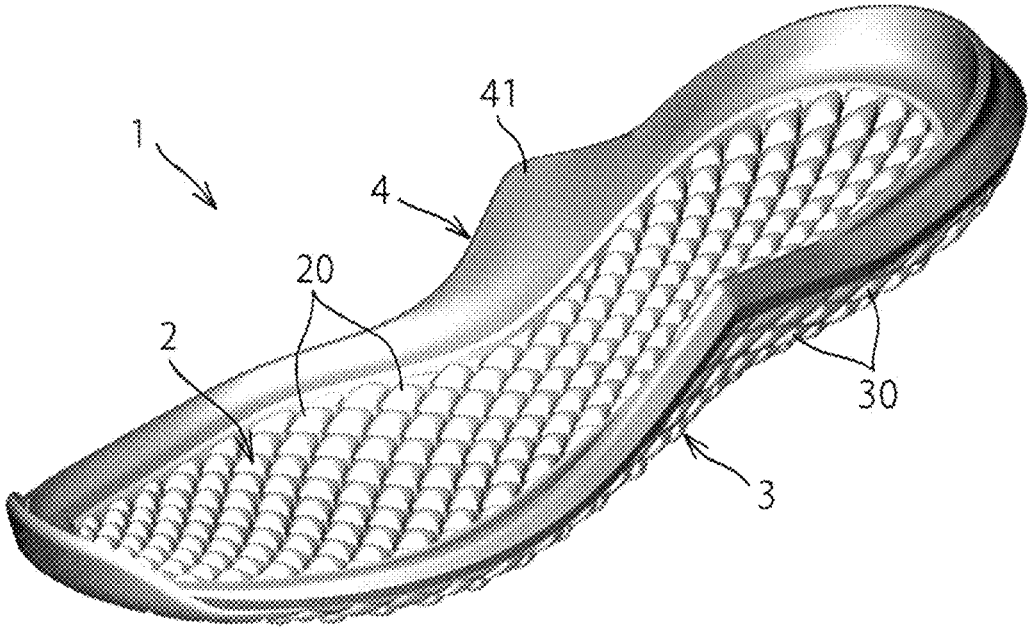
FIG. 1 is a general perspective view of a sole structure for a shoe according to the present invention.
Figure 3:
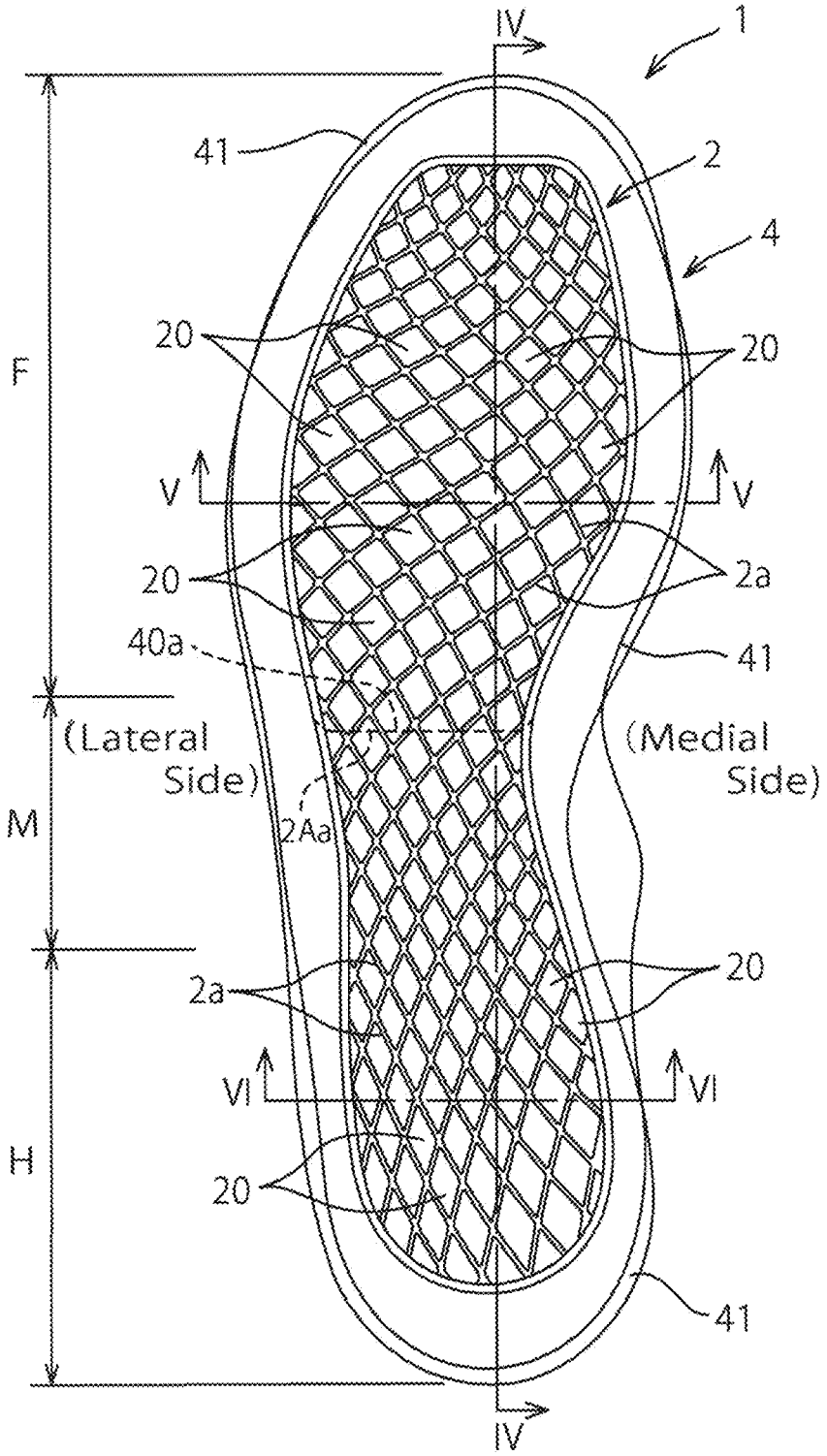
FIG. 3 is a top plan view of a sole structure for a shoe according to a first embodiment of the present invention.

For example, in FIG. 1, a general perspective view of the sole structure, "upward" and "downward" generally designate "upward" and "downward" in FIG. 1 respectively, "forward" and "rearward" generally designate "left to right direction" in FIG. 1 and "a width direction" generally designates "out of the page" and "into the page" of FIG. 1 respectively. Similarly, in FIG. 3, a top plan view of the sole structure, "upward" and "downward" designate "out of the page" and "into the page" of FIG. 3 respectively, "forward" and "rearward" designate "upward" and "downward" in FIG. 3 respectively, and "a width direction" designates "left to right direction" in FIG. 3.

Figure 4:
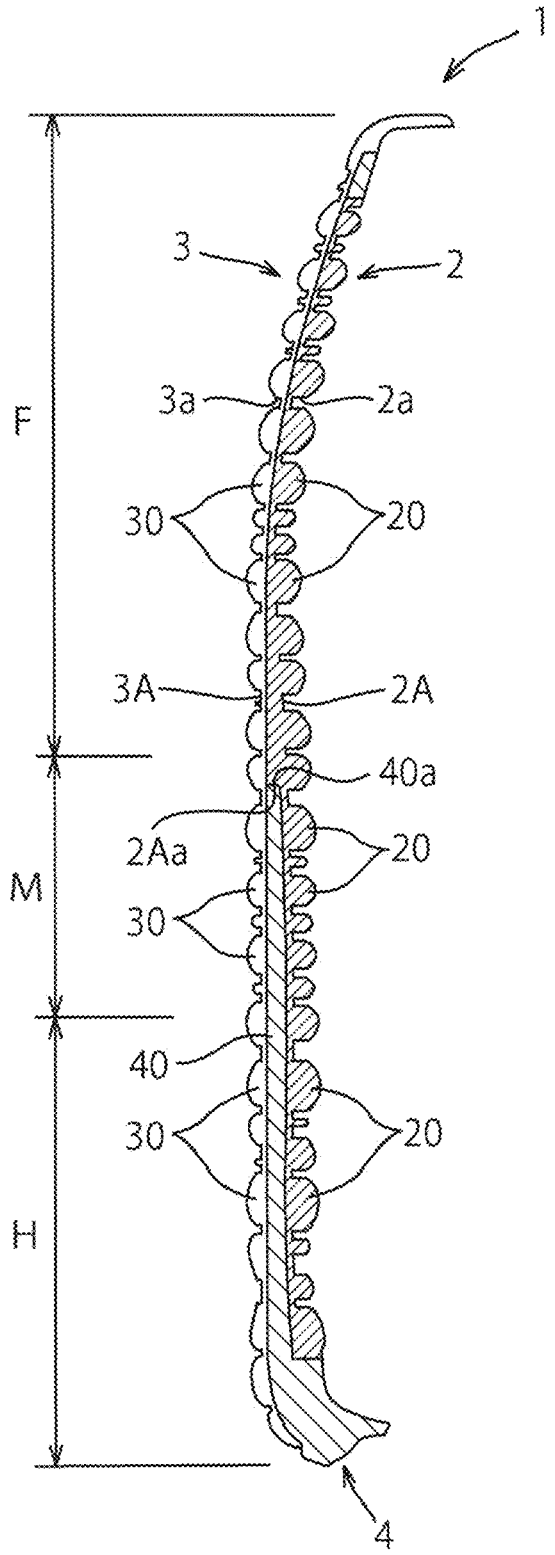
FIG. 4 is a sectional view of FIG. 3 taken along line IV-IV illustrating a longitudinal sectional view along a longitudinal centerline of the sole structure of FIG. 3.
Figure 5:
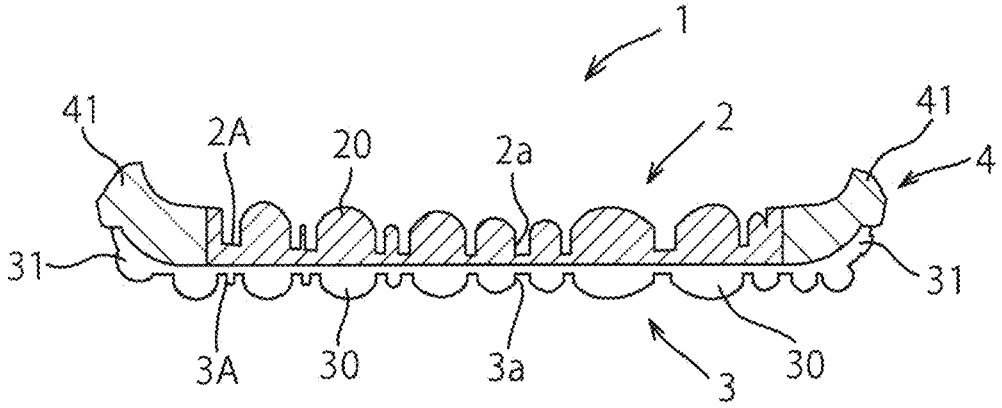
FIG. 5 is a sectional view of FIG. 3 taken along line V-V illustrating a cross sectional view of the sole structure of FIG. 3.
Figure 6:
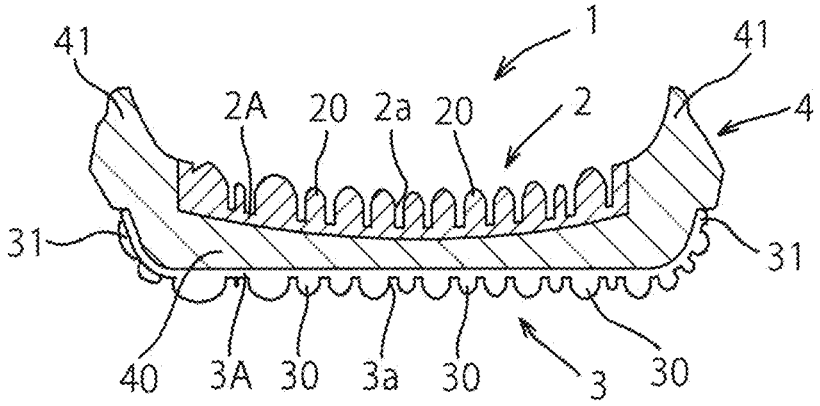
FIG. 6 is a sectional view of FIG. 3 taken along line VI-VI illustrating a cross sectional view of the sole structure of FIG. 3.
Figure 7:
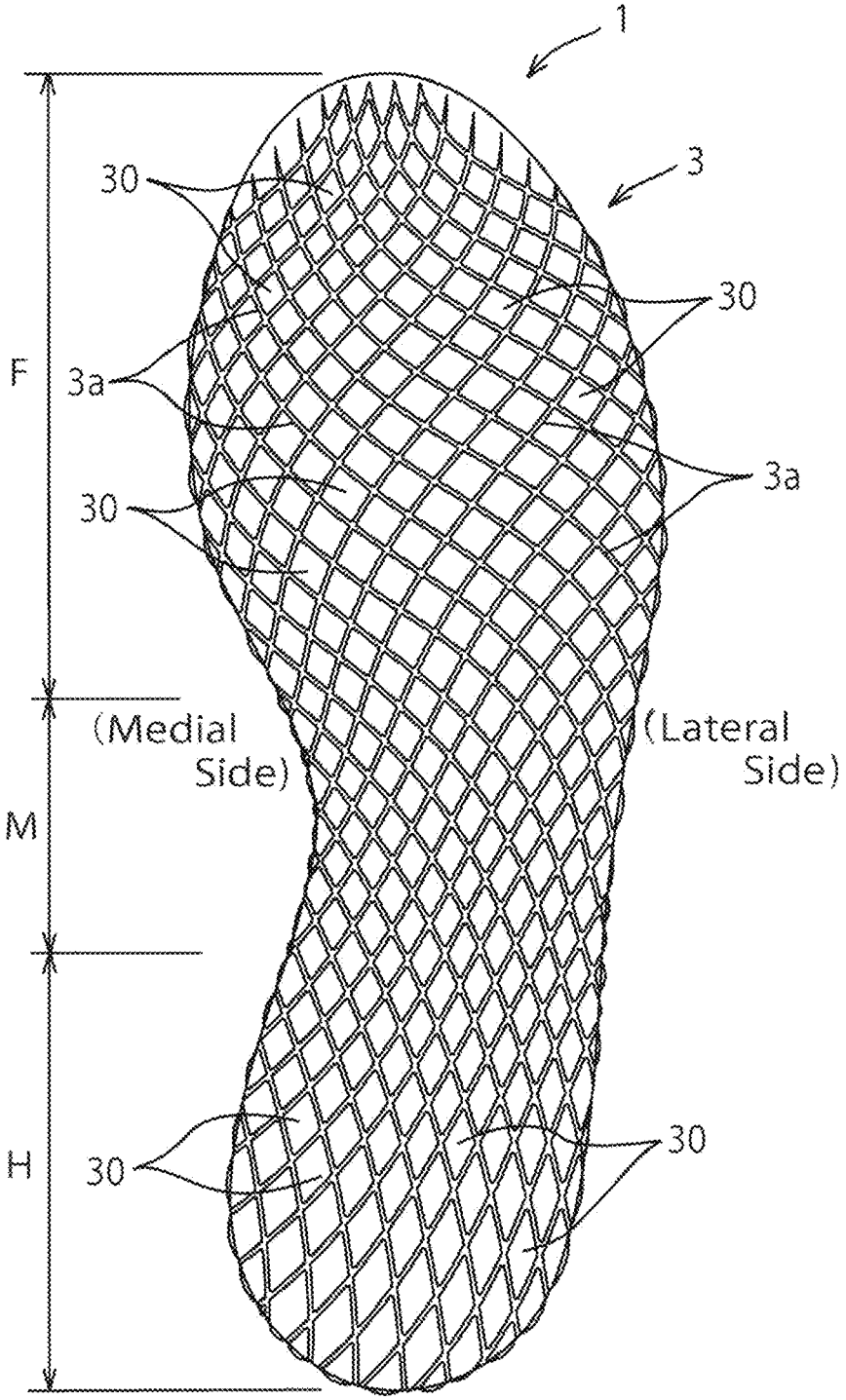
FIG. 7 is a bottom view of the sole structure of FIG. 3.
Figure 8:
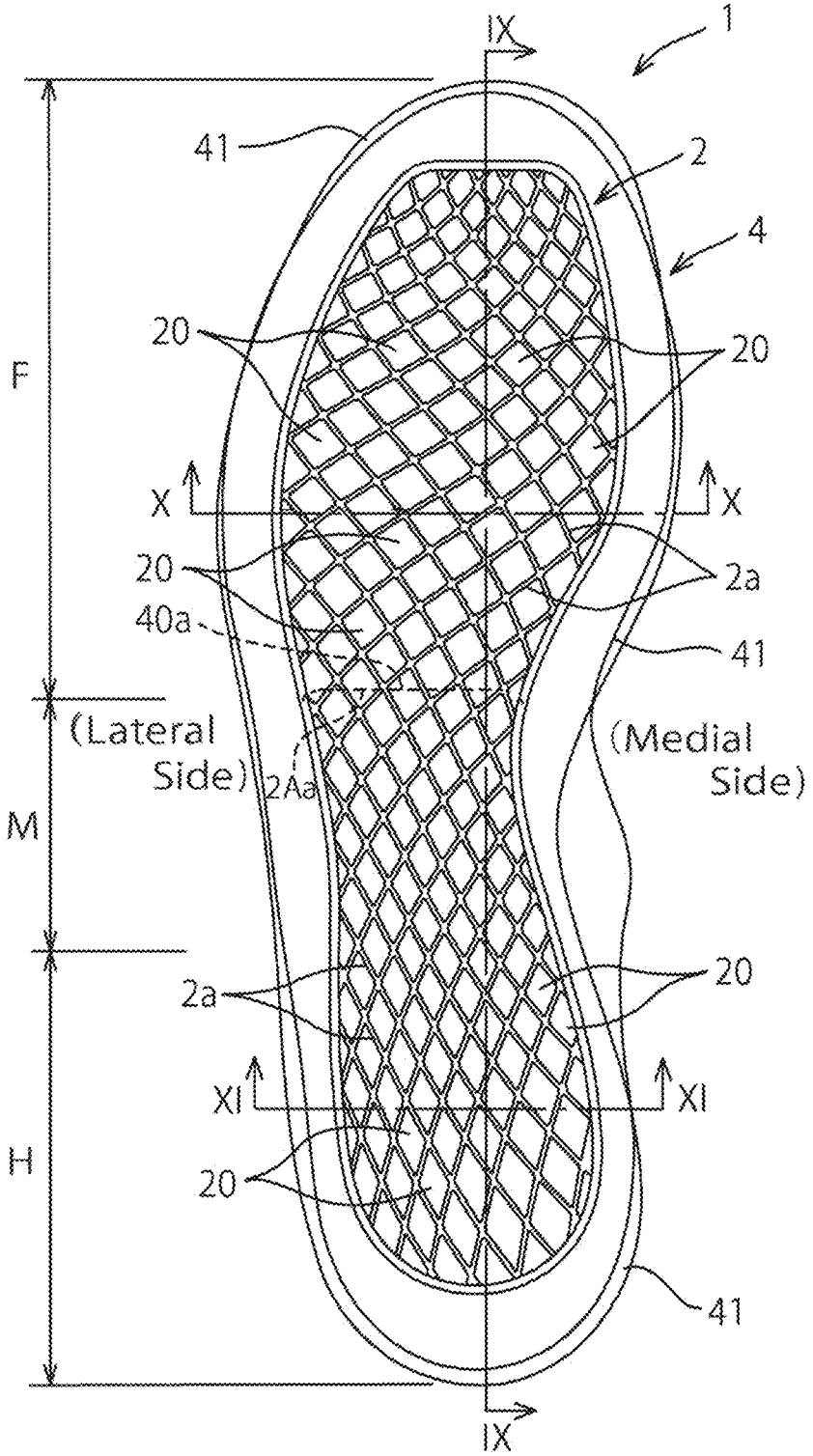
FIG. 8 is a top plan view of a sole structure for a shoe according to a second embodiment of the present invention.
Figure 9:
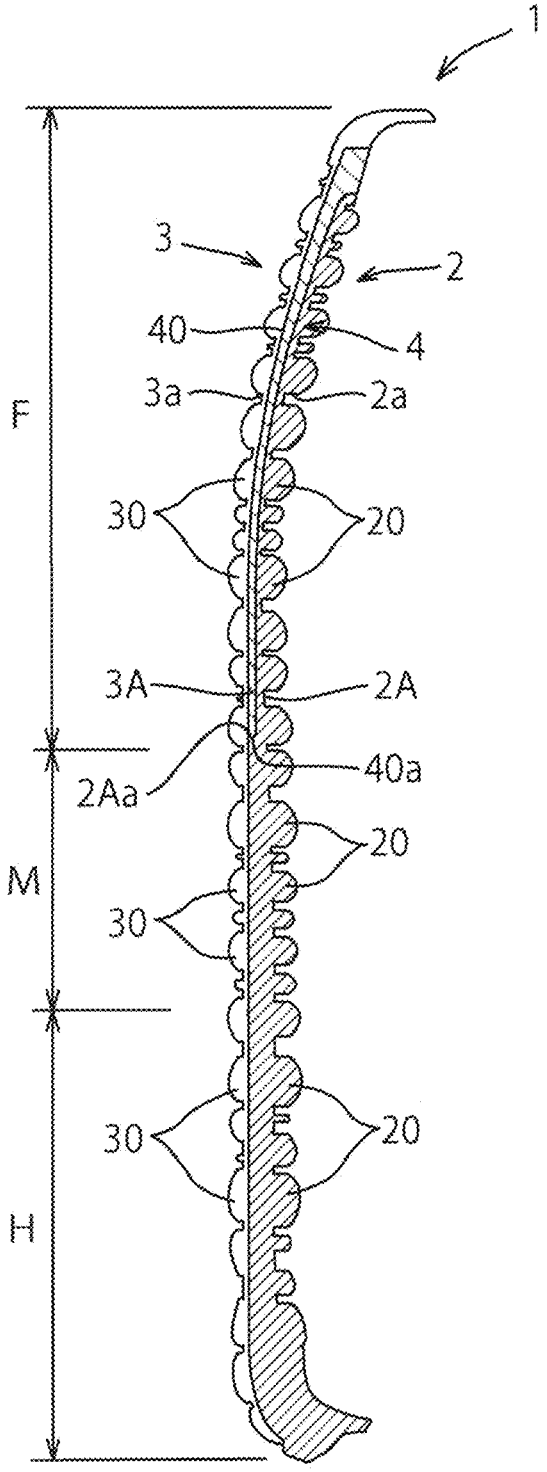
FIG. 9 is a sectional view of FIG. 8 taken along line IX-IX illustrating a longitudinal sectional view along a longitudinal centerline of the sole structure of FIG. 8.
Figure 10:
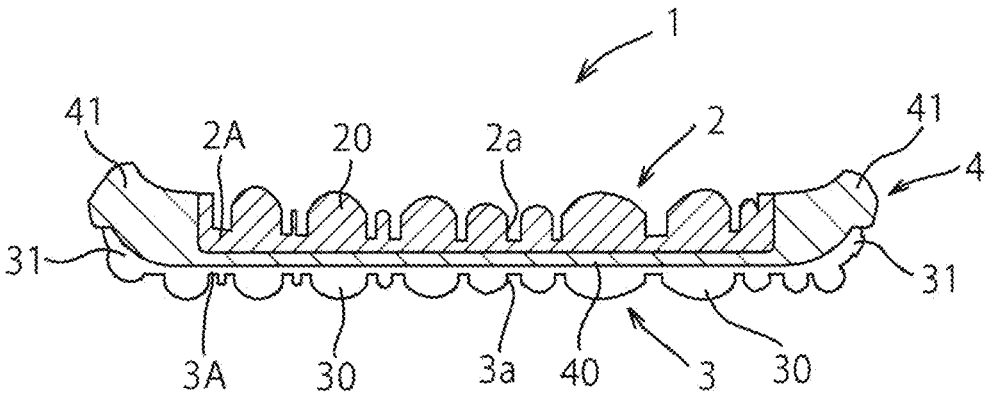
FIG. 10 is a sectional view of FIG. 8 taken along line X-X illustrating a cross sectional view of the sole structure of FIG. 8.
Figure 11:
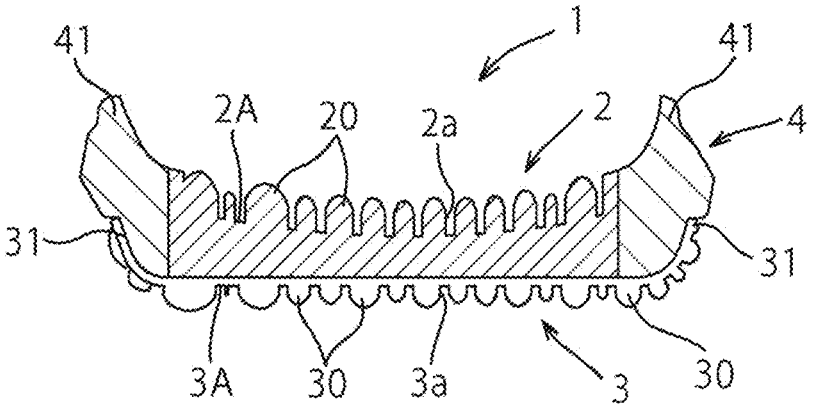
FIG. 11 is a sectional view of FIG. 8 taken along line XI-XI illustrating a cross sectional view of the sole structure of FIG. 8.
Figure 12:
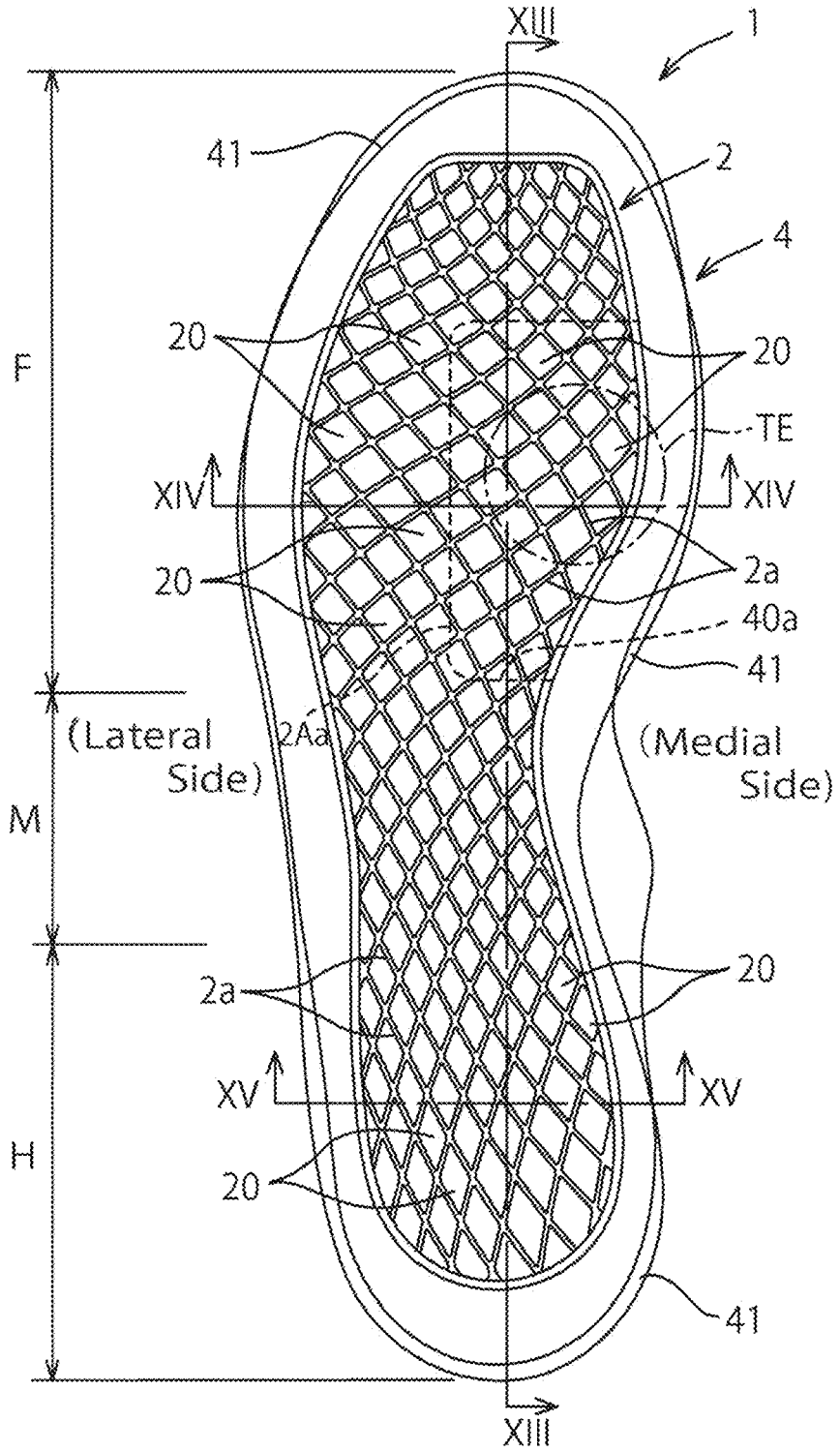
FIG. 12 is a top plan view of a sole structure for a shoe according to a third embodiment of the present invention.
Figure 13:
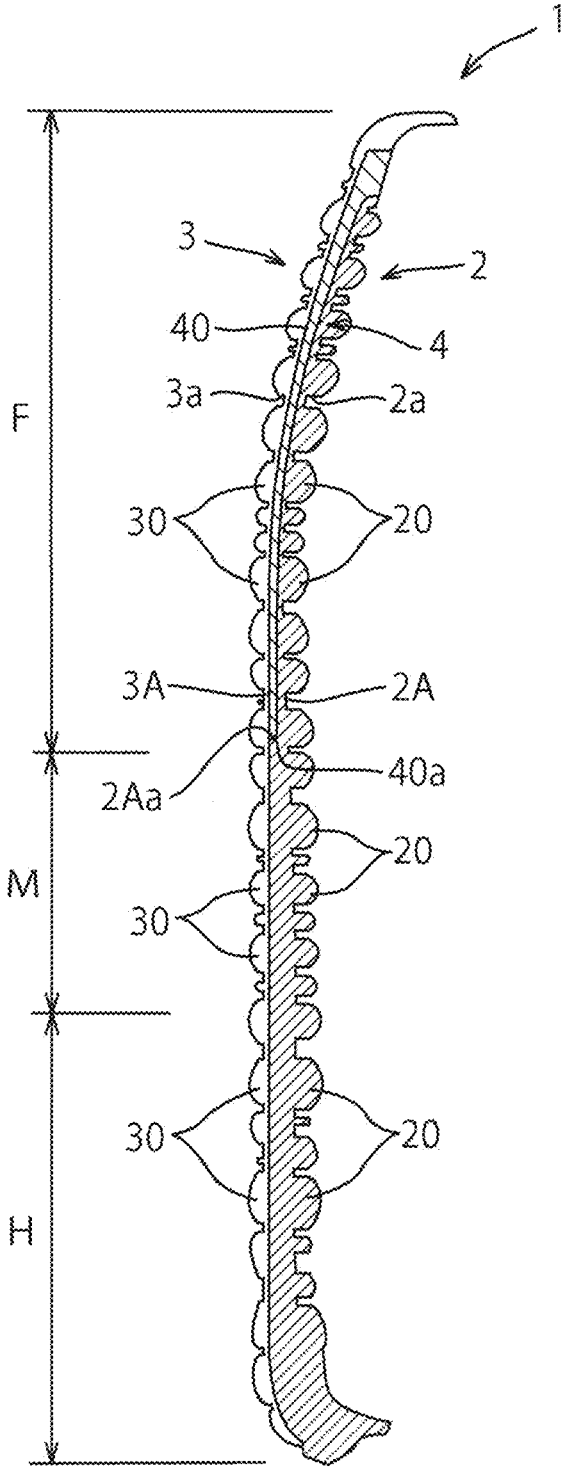
FIG. 13 is a sectional view of FIG. 12 taken along line XIII-XIII illustrating a longitudinal sectional view along a longitudinal centerline of the sole structure of FIG. 12.
Figure 14:
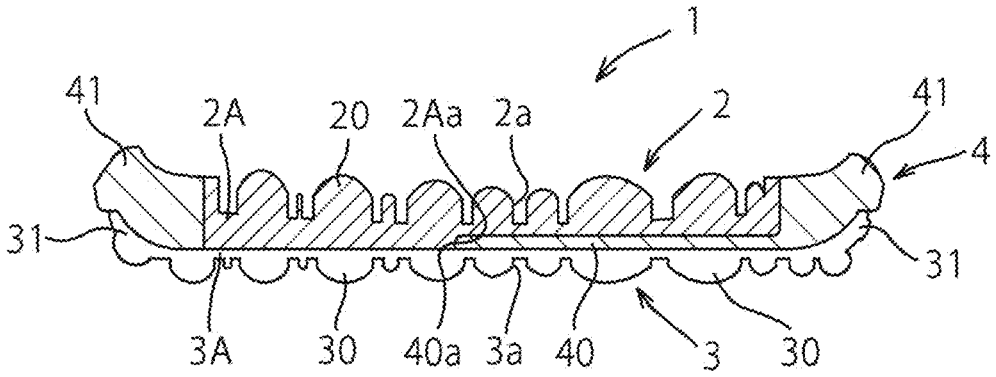
FIG. 14 is a sectional view of FIG. 12 taken along line XIV-XIV illustrating a cross sectional view of the sole structure of FIG. 12.
Figure 15:
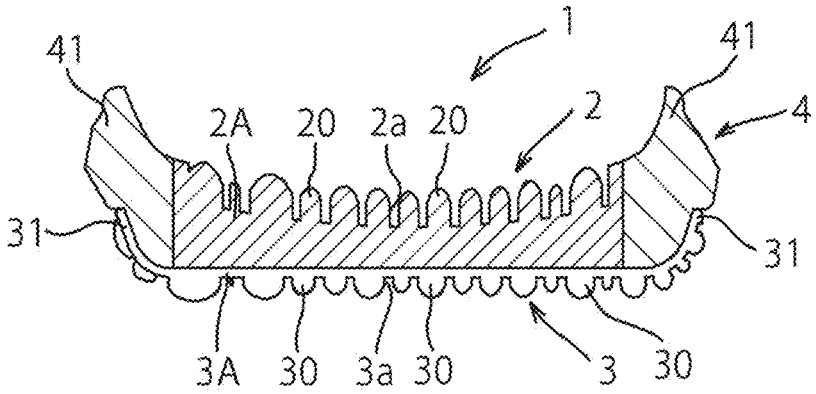
FIG. 15 is a sectional view of FIG. 12 taken along line XV-XV illustrating a cross sectional view of the sole structure of FIG. 12.
Figure 16:
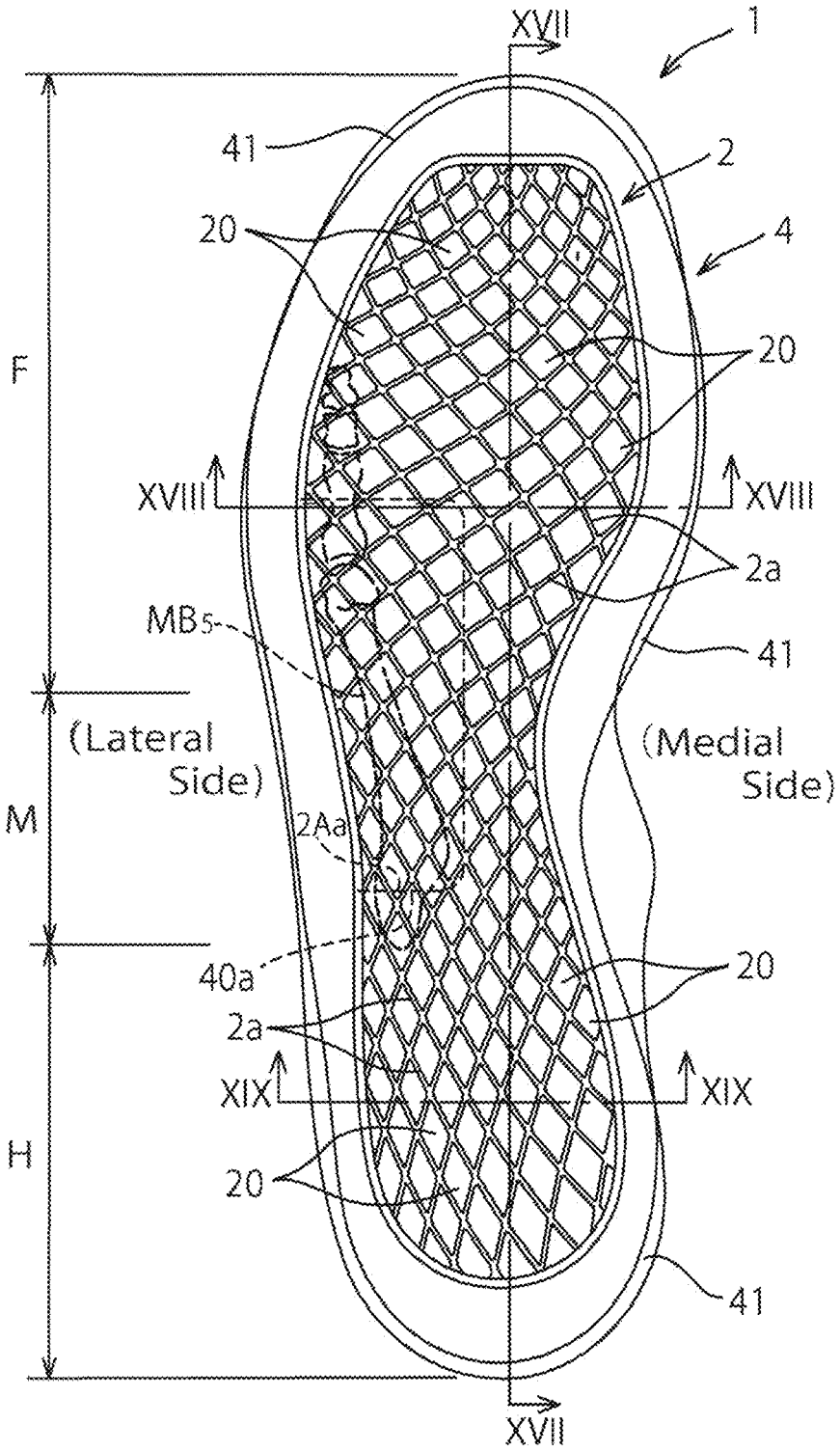
FIG. 16 is a top plan view of a sole structure for a shoe according to a fourth embodiment of the present invention.
Figure 17:
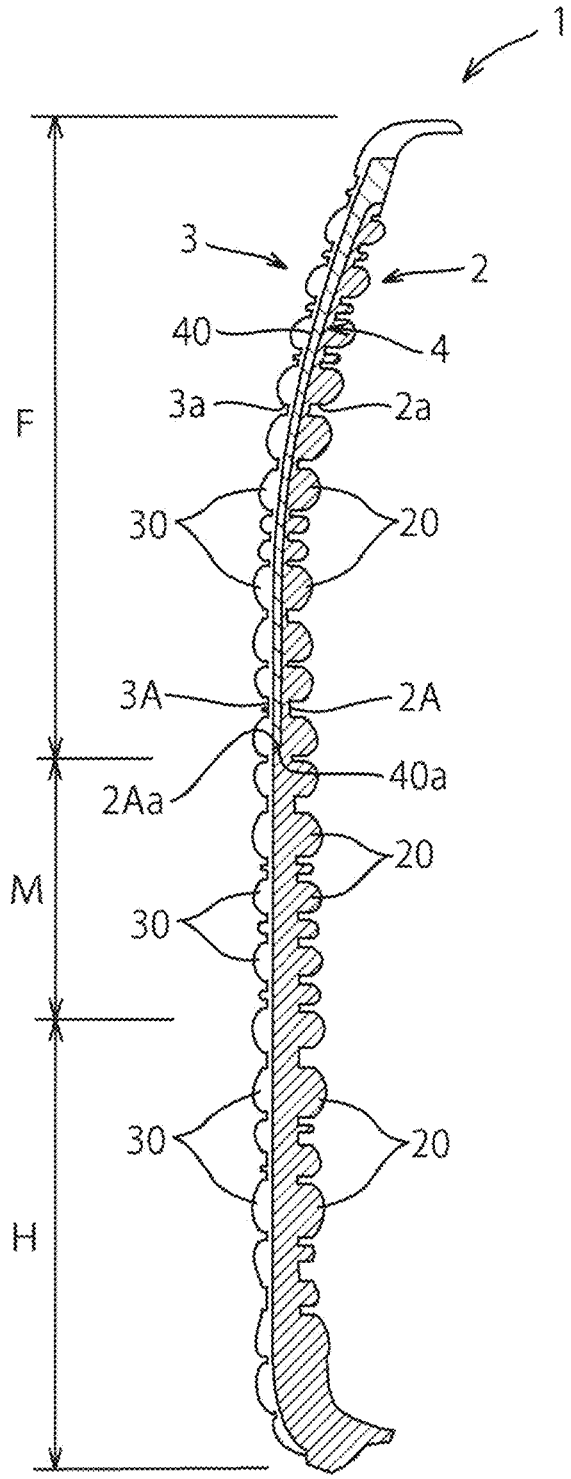
FIG. 17 is a sectional view of FIG. 16 taken along line XVII-XVII illustrating a longitudinal sectional view along a longitudinal centerline of the sole structure of FIG. 16.
Figure 18:
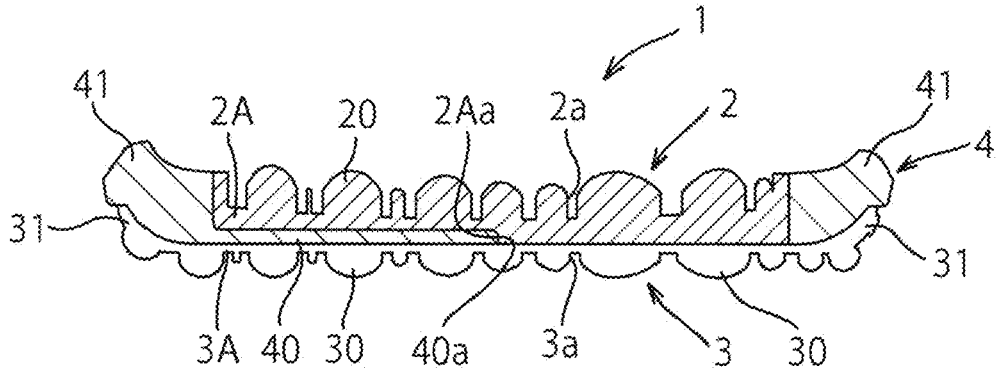
FIG. 18 is a sectional view of FIG. 16 taken along line XVIII-XVIII illustrating a cross sectional view of the sole structure of FIG. 16.
Figure 19:
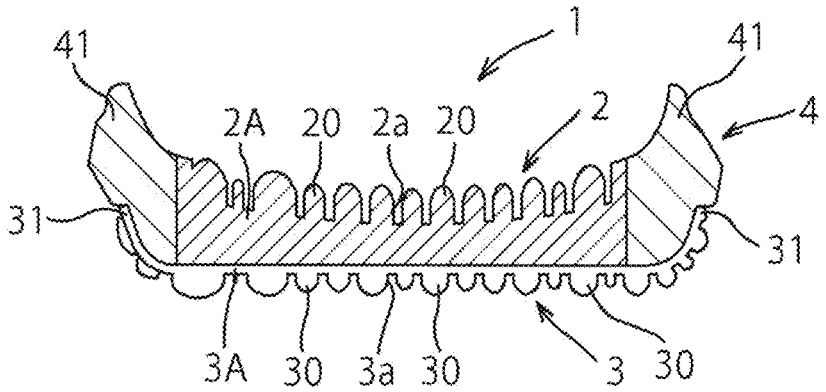
FIG. 19 is a sectional view of FIG. 16 taken along line XIX-XIX illustrating a cross sectional view of the sole structure of FIG. 16.
Figure 20:
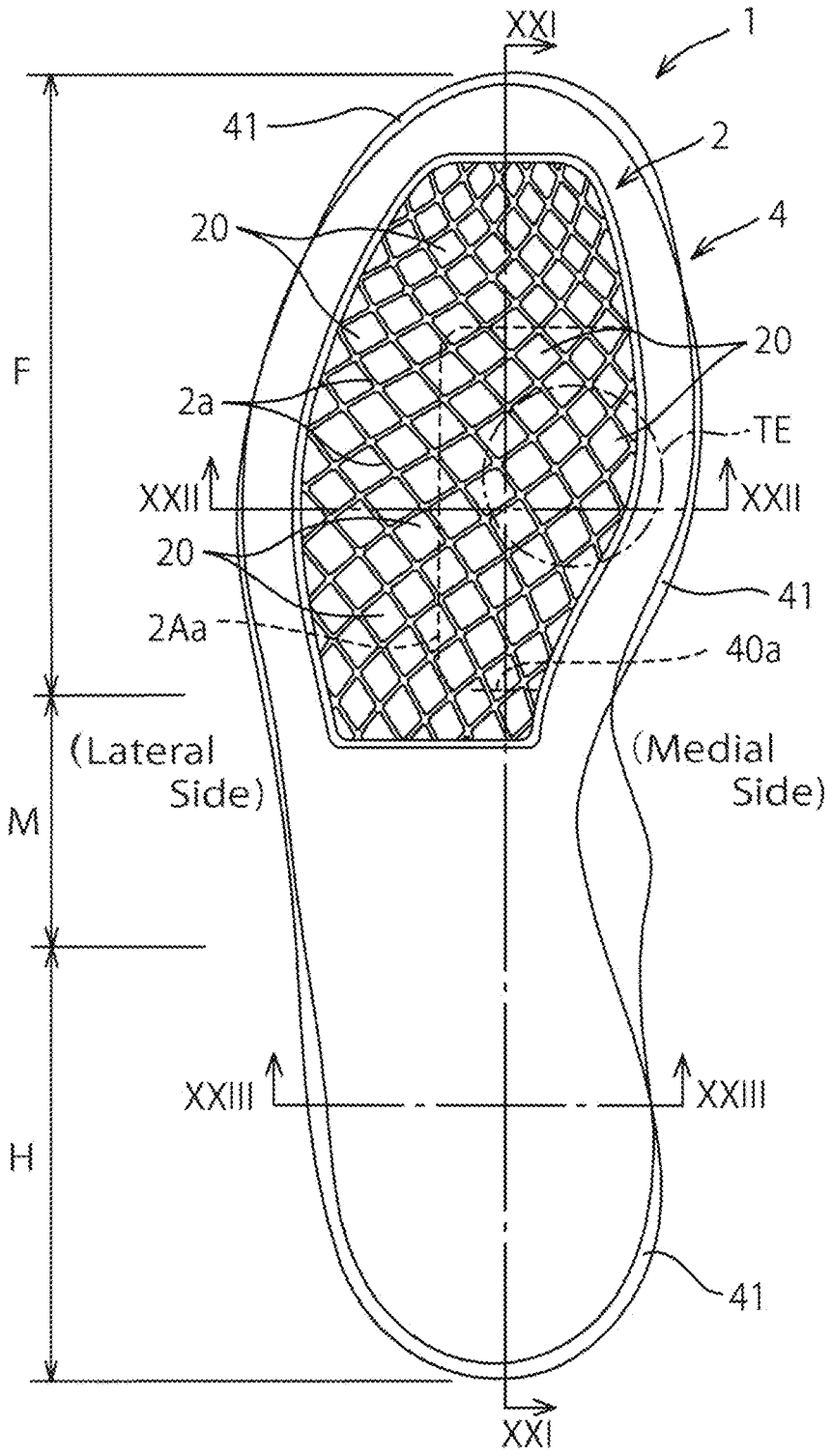
FIG. 20 is a top plan view of a sole structure for a shoe according to a fifth embodiment of the present invention.
Figure 21:
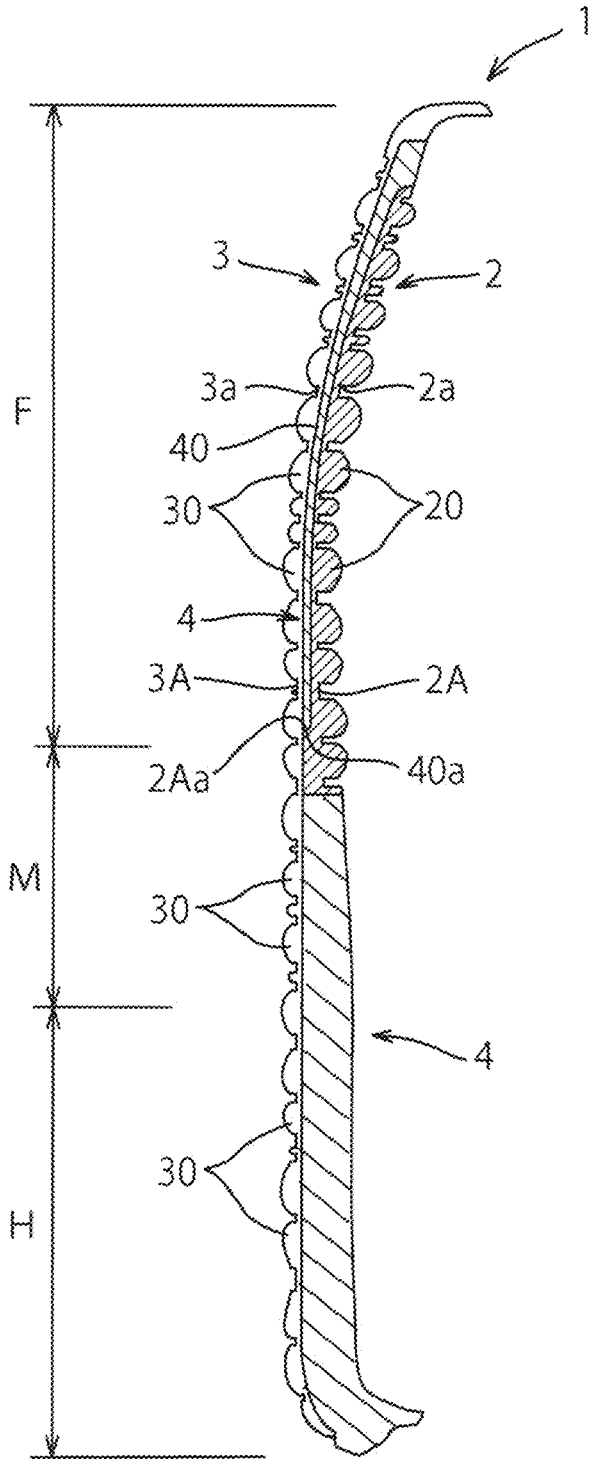
FIG. 21 is a sectional view of FIG. 20 taken along line XXI-XXI illustrating a longitudinal sectional view along a longitudinal centerline of the sole structure of FIG. 20.
Figure 22:
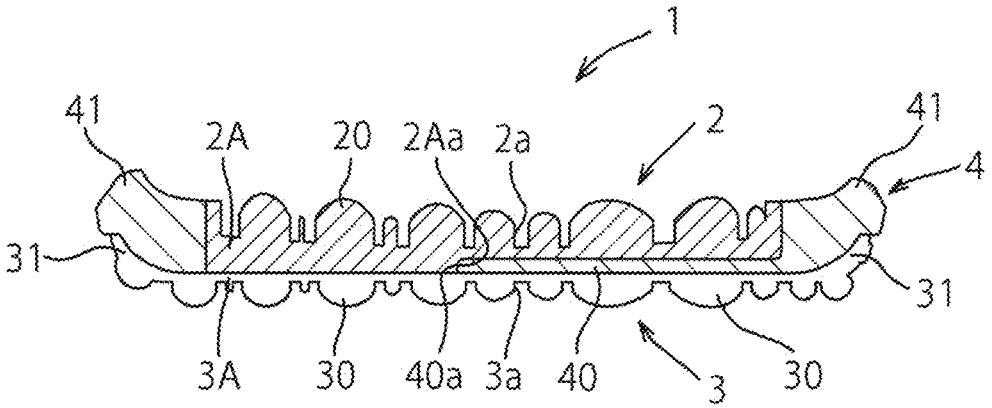
FIG. 22 is a sectional view of FIG. 20 taken along line XXII-XXII illustrating a cross sectional view of the sole structure of FIG. 20.
Figure 23:
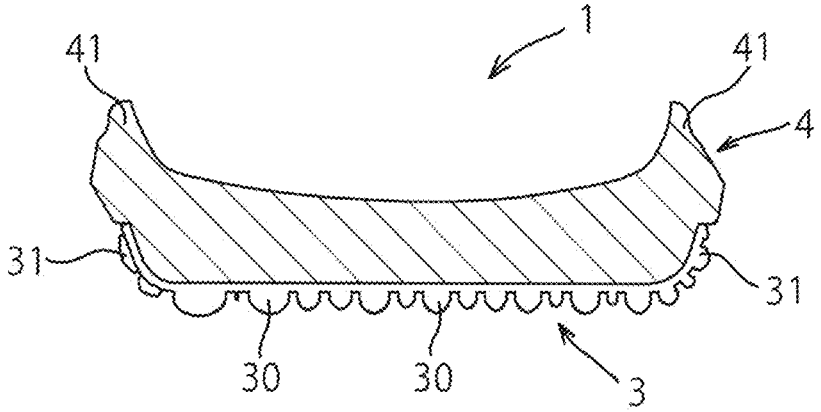
FIG. 23 is a sectional view of FIG. 20 taken along line XXIII-XXIII illustrating a cross sectional view of the sole structure of FIG. 20.
Figure 24:
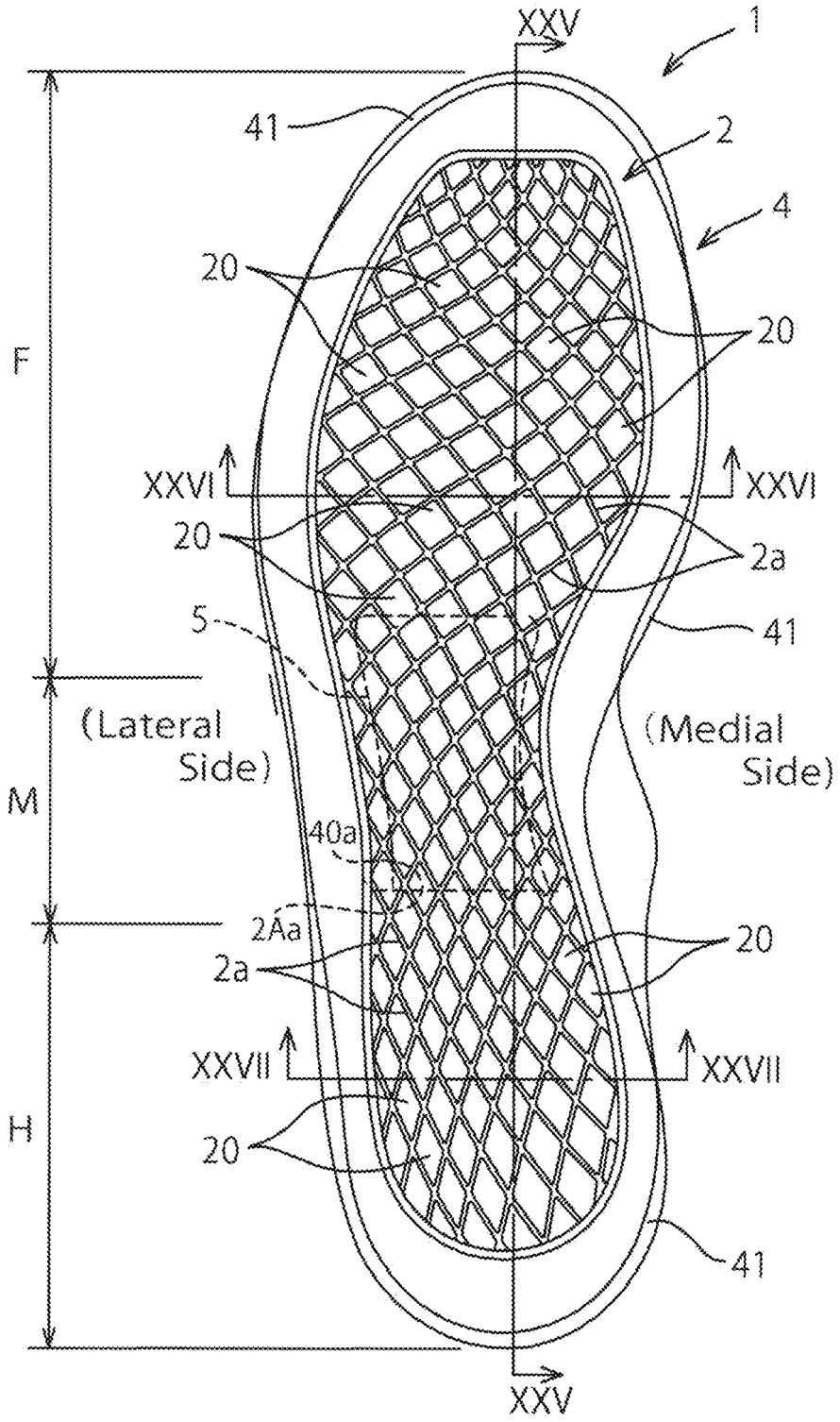
FIG. 24 is a top plan view of a sole structure for a shoe according to a sixth embodiment of the present invention.
Figure 25:
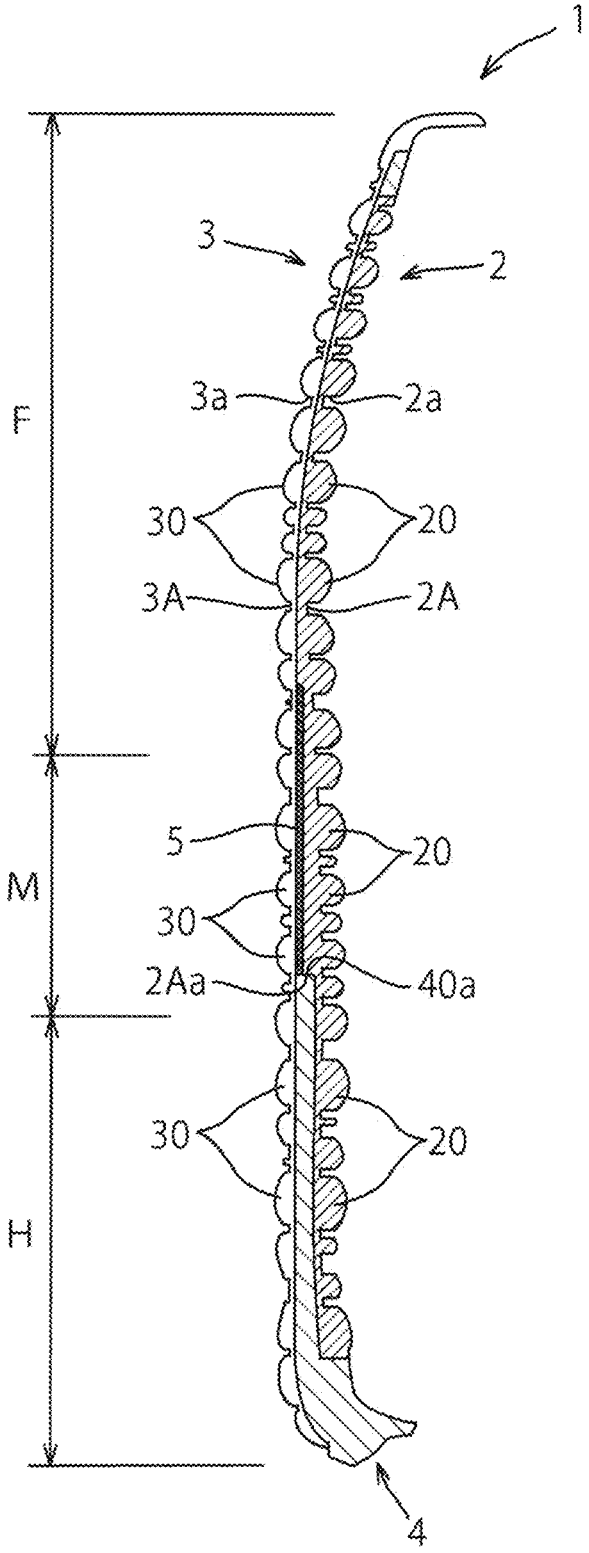
FIG. 25 is a sectional view of FIG. 24 taken along line XXV-XXV illustrating a longitudinal sectional view along a longitudinal centerline of the sole structure of FIG. 24.
Figure 26:
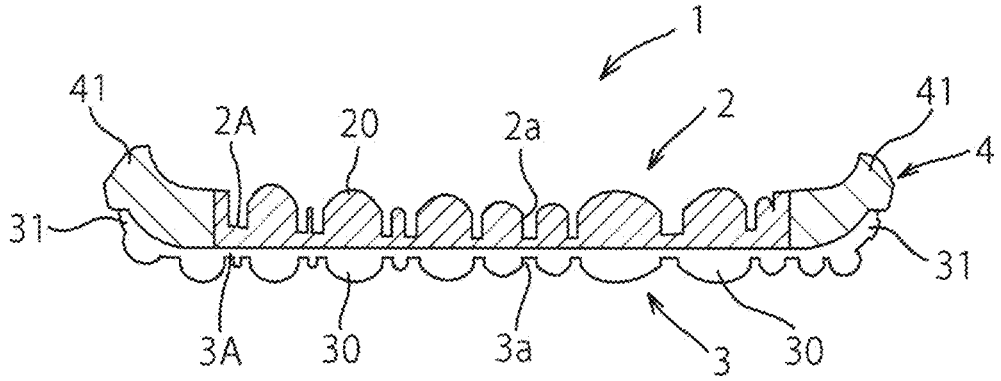
FIG. 26 is a sectional view of FIG. 24 taken along line XXVI-XXVI illustrating a cross sectional view of the sole structure of FIG. 24.
Figure 27:
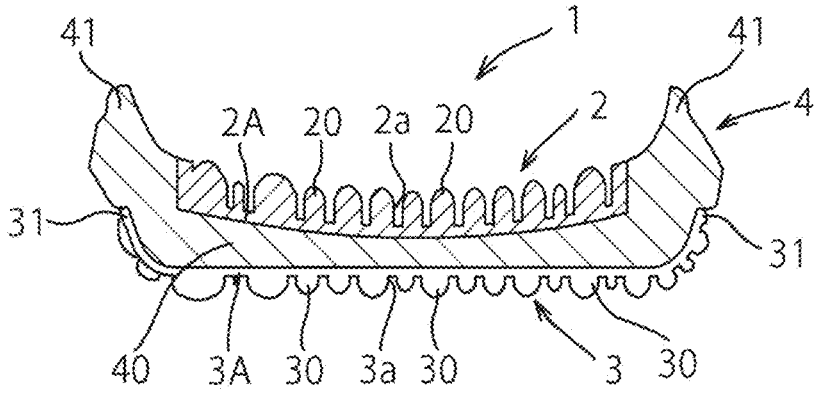
FIG. 27 is a sectional view of FIG. 24 taken along line XXVII-XXVII illustrating a cross sectional view of the sole structure of FIG. 24.

Also, in FIG. 4, a longitudinal sectional view and in FIGS. 5, 6, cross sectional views, only the first midsole 2 and the second midsole 4 constituting the sole structure according to the present embodiment are shown by hatching and hatching of the outsole 3 is not shown for illustration purposes. In FIG. 9, reference characters H, M and F designate a heel region, a midfoot region and a forefoot region of the sole structure, respectively, which are adapted to correspond to a heel portion, a midfoot portion and a forefoot portion of a foot of a shoe wearer, respectively.

Entire Structure

Figure 2:
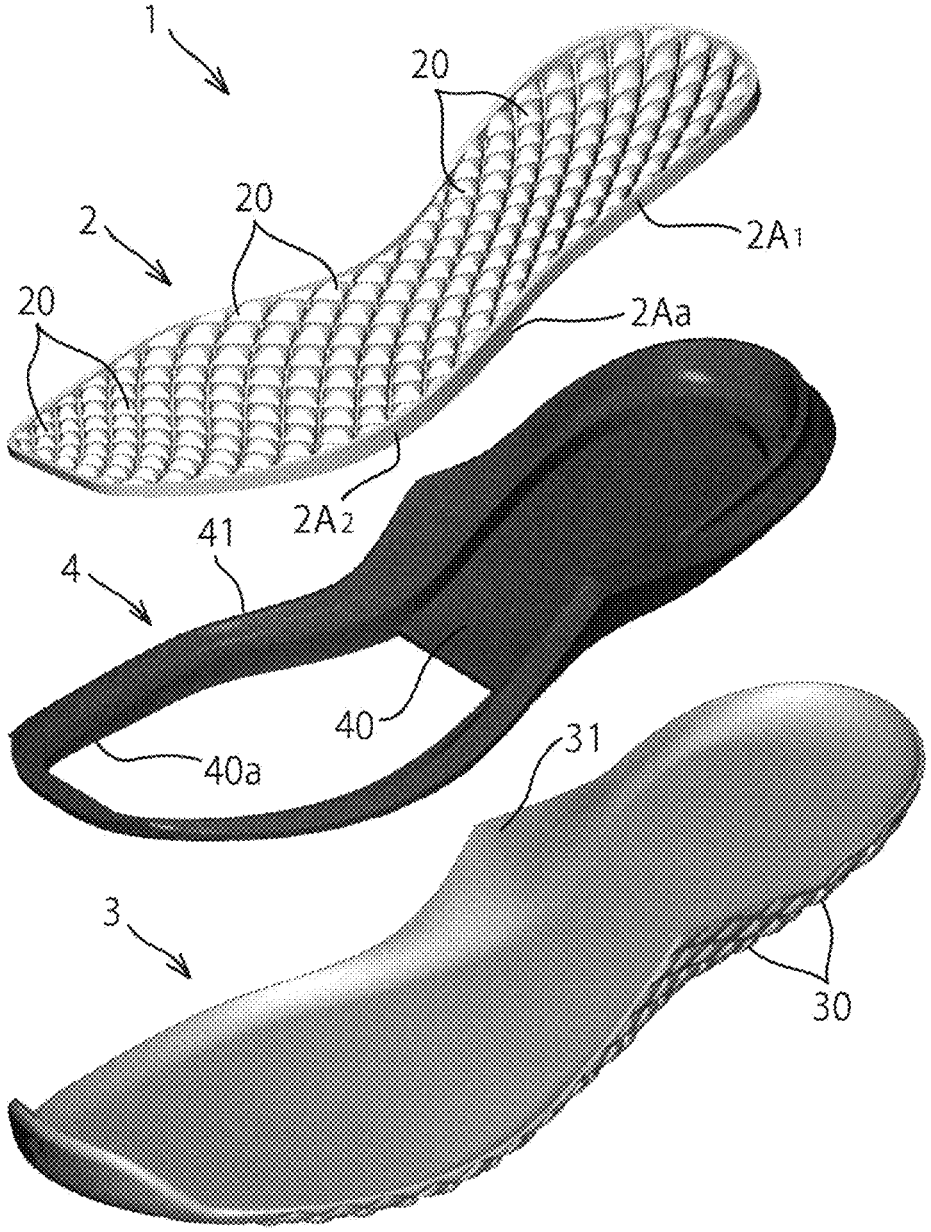
FIG. 2 is an exploded perspective view of the sole structure of FIG. 1.

FIG. 1 is a general perspective view of the sole structure of the present invention, and FIG. 2 is an exploded view of the sole structure. As shown in these drawings, sole structure 1 includes a first midsole 2 disposed on an upper side of the sole structure 1, an outsole 3 disposed on a lower side of the sole structure 1, and a second midsole 4 disposed between the first midsole 2 and the outsole 3. The first midsole 2, the second midsole 4 and the outsole 3 are overlapped with each other in a vertical direction.

The first midsole 2 is a member disposed on a foot-sole-contact side and has a large number of first protrusions 20 on an upper side (i.e. on a foot-sole-contact side). The first protrusions 20 are distributed on an entire upper side surface of the first midsole 2. The outsole 3 is a member disposed on a ground surface side of the sole structure 1 and has a large number of second protrusions 30 on a bottom side (i.e. on a ground surface side). The second protrusions 30 are distributed on an entire bottom side surface of the outsole 3. The second midsole 4 is a member sandwiched or interposed between the first midsole 2 and the outsole 3 and has a generally planar bottom wall surface (or sheet portion) 40, and an opening 40*a* penetrating vertically through the second midsole 4. In this example, the bottom wall surface 40 is located at a rearfoot region of the second midsole 4 and the opening 40*a* is located at the forefoot region.

At the rearfoot region of the sole structure 1, a bottom or lower surface of the first midsole 2 indirectly contacts or bears on a top surface or upper surface of the outsole 3 via the bottom wall surface 40 of the second midsole 4. At the forefoot region of the sole structure 1, the bottom or lower surface of the first midsole 2 directly contacts the top surface or upper surface of the outsole 3 through the opening 40*a* of the second midsole 4. A thickness of the first midsole 2 differs between the rearfoot region $2A_1$ and the forefoot region $2A_2$. A thickness of the rearfoot region $2A_1$ is thinner than a thickness of the forefoot region $2A_2$ (excluding a thickness of a toe of the foot) and there is formed a stepped part 2Aa at a boundary between the rearfoot region $2A_1$ and the forefoot region $2A_2$. The rearfoot region $2A_1$ contacts the bottom wall surface 40 of the second midsole 4. The forefoot region $2A_2$ fits (or nests) in the opening 40*a* of the second midsole 4 and contacts the below-disposed outsole 3 through the opening 40*a*.

A material having a settling resistance is preferable for the first midsole 2. For example, polyurethane (PU), rubber or the like may be used. A material having cushioning properties is preferable for the second midsole 4. For example, a material having a lower compressive rigidity than the first midsole 2, such as ethylene-vinyl acetate copolymer (EVA) of a higher expansion ratio or the like may be used for the second midsole 4. A material of a lower compressive rigidity (i.e. a lower rigidity against a compressive force) has high cushioning properties. In an alternative embodiment, contrary to the above-mentioned examples, EVA may be used for the first midsole 2 and PU may be used for the second midsole 4, as long as the compressive rigidity of the second midsole 4 is less than the compressive rigidity of the first midsole 2. As a further alternative, provided that the compressive rigidity of the second midsole 4 is less than the compressive rigidity of the first midsole 2, EVA or PU may be used for both the first midsole 2 and the second midsole 4. Alternatively, materials other than EVA and PU may be used for both the first midsole 2 and the second midsole 4. A wear-resistant material is preferable for the outsole 3. For example, polyurethane (PU), rubber or the like may be used. A material having a relatively greater hardness is preferable.

First Embodiment

FIGS. 3 to 7 show a sole structure for a shoe according to the first embodiment of the present invention. As shown in FIGS. 3 to 7, the first midsole 2 and the outsole 3 constituting the sole structure 1 extend from the heel region H through the midfoot region M to the forefoot region F. A large number of first protrusions 20 provided on the upper surface side of the first midsole 2 are spaced apart at a predetermined interval on the upper surface of the first midsole 2 in the longitudinal direction and the width direction. Similarly, a large number of second protrusions 30 provided on the lower surface side of the outsole 3 are spaced apart at a predetermined interval on the lower surface of the first midsole 2 in the longitudinal direction and the width direction. The respective first protrusions 20 are located at positions that correspond vertically to the respective second protrusions 30. Preferably, the first protrusions 20 has a one-to-one correspondence relation relative to the second protrusions 30 (see FIGS. 4 to 6).

The first midsole 2 has a thin-plate-like base portion 2A of a uniform thickness. A plurality of first protrusions 20 are separated from each other and protrude from a base surface or a top surface of the base portion 2A. In other words, the first protrusions 20 adjacent each other on the base surface of the base portion 2A are divided and separated by a plurality of grooves 2*a* intersecting each other and each having the base surface as its bottom surface. In this example, each of the first protrusions 20 has a generally rhombus shape or a generally rectangular shape as viewed from above. Likewise, the second protrusion 30 of the outsole 3 has a generally rhombus shape or a generally rectangular shape as viewed from below. A thickness of the base portion 2A is set to for example, approximately 2 mm (or less). Each of the first and second protrusions 20, 30 has a convexly curved surface (or convexly circular arc surface) whose central portion protrudes.

The second midsole 4 has a bottom wall surface 40 that is disposed at a rearfoot region (including the heel region H and the midfoot region M) of the sole structure 1 and that extends along the entire rearfoot region, and an upraised portion 41 that extends upwardly from a circumferential portion of the bottom wall surface 40 and that circumscribes and extends upwardly from a perimeter of the opening 40*a* formed at the forefoot region F. The upraised portion 41 is so structured as to enclose the circumferential portion of the first midsole 2 with the first midsole 2 fitted into the second midsole 4 (see FIG. 1). The outsole 3 also has a similar upraised portion 31 and the second protrusions 30 are also provided on a bottom surface of the upraised portion 31.

On the other hand, the first midsole 2 does not have an upraised portion that corresponds to the upraised portion 31 of the outsole 3. Therefore, the first midsole 2 has no first protrusions that correspond to the second protrusions 30 of the upraised portion 31 of the outsole 3. Accordingly, this specification does not describe that there is one-to-one correspondence relation between the first protrusions 20 and the second protrusions 30, but it describes that the first protrusions 20 has a one-to-one correspondence relation relative to the second protrusions 30.

According to the above-mentioned sole structure 1, when the second protrusions 30 of the outsole 3 come into contact with the ground at the time of ground contact, a ground surface information such as the size and direction of the ground reaction force acting from the ground to the second protrusions 30, and angularities of the ground surface or the like are transmitted to the first protrusions 20 of the first midsole 2 disposed at a position corresponding vertically to the second protrusions 30 of the outsole 3, and then transmitted to a foot sole of a shoe wearer from the first protrusions 20. Thereby, the ground surface information is feedbacked to the foot sole of the wearer.

Here, since the bottom wall surface 40 of the second midsole 4 is disposed at the rearfoot region including the heel region H and the midfoot region M, the ground reaction force at the rearfoot region when landing onto the ground is transmitted from the second protrusions 30 of the outsole 3 through the bottom wall surface 40 of the second midsole 4 to the first protrusions 20 of the first midsole 2.

At this juncture, since the bottom wall surface 40 of the second midsole 4 has a lower compressive rigidity than the first midsole 2 and can thus absorb the ground reaction force, interposition of the bottom wall surface 40 can improve cushioning properties at the rearfoot region. A large impact load equivalent to a few times as large as a wearer's weight is imparted to the rearfoot region at the time of impacting the ground. Therefore, when such an impact load is absorbed by the bottom wall surface 40, it can be prevented that a large thrust is locally exerted from the first protrusions 20 to the foot sole at the rearfoot region. Also, even in the case that the first protrusions 20 of the first midsole 2 at the rearfoot region is formed of a material having a high settling resistance, the bottom wall surface 40 of the second midsole 4 can improve cushioning properties at the rearfoot region. Thereby, a feedback of the ground surface information and a maintenance of cushioning properties can be achieved at the rearfoot region for a prolonged period of time.

On the other hand, the bottom wall surface 40 of the second midsole 4 is not provided at the forefoot region F but the opening 40*a* is disposed at the forefoot region F and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer.

In the first embodiment, an example was shown in which the bottom wall surface 40 of the second midsole 4 functioning as a sheet surface for cushioning is disposed at the rearfoot region (that is, a region from the heel region H to the midfoot region M) of the sole structure 1, but the present invention is not limited to such an example. In the present invention, the bottom wall surface 40 of the second midsole 4 may be disposed at any other region or place. The bottom wall surface 40 of the second midsole 4 is disposed at a part of a region between the first midsole 2 and the outsole 3.

Second Embodiment

FIGS. 8 to 11 show a sole structure for a shoe according to a second embodiment of the present invention. In these drawings, like reference numbers indicate identical or functionally similar elements in the first embodiment. In this second embodiment, the bottom wall surface 40 of the second midsole 4 is disposed at and extends throughout the forefoot region F and the opening 40*a* of the second midsole 4 is disposed at the rearfoot region.

In this second embodiment, as with the first embodiment, when the second protrusions 30 of the outsole 3 come into contact with the ground at the time of ground contact, the ground surface information such as the size and direction of the ground reaction force acting from the ground to the second protrusions 30, and angularities of the ground surface or the like are transmitted to the first protrusions 20 of the first midsole 2 disposed at the position corresponding vertically to the second protrusions 30 of the outsole 3, and then transmitted to the foot sole of the shoe wearer from the first protrusions 20. Thereby, the ground surface information is feedbacked to the foot sole of the wearer.

In this case, since the bottom wall surface 40 of the second midsole 4 is disposed at the forefoot region F, the ground reaction force at the forefoot region F when landing onto the ground is transmitted from the second protrusions 30 of the outsole 3 through the bottom wall surface 40 of the second midsole 4 to the first protrusions 20 of the first midsole 2.

At this time, since the bottom wall surface 40 of the second midsole 4 has a lower compressive rigidity than the first midsole 2 and can thus absorb the ground reaction force, interposition of the bottom wall surface 40 can improve cushioning properties at the forefoot region F and relieve a thrust force locally exerted from the first protrusions 20 to the foot sole at the forefoot region F. Also, even in the case that the first protrusions 20 of the first midsole 2 at the forefoot region F are formed of a material having a high settling resistance, the bottom wall surface 40 of the second midsole 4 can improve cushioning properties at the forefoot region F. Thereby, the feedback of the ground surface information and the maintenance of cushioning properties can be achieved at the forefoot region F for a prolonged period of time.

On the other hand, the bottom wall surface 40 of the second midsole 4 is not provided at the rearfoot region but the opening 40*a* is disposed at the rearfoot region and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer. In this case, an impact load imparted to the rearfoot region at the time of impacting the ground can be absorbed by thickening a thickness of the first midsole 2 (see FIG. 11).

Third Embodiment

FIGS. 12 to 15 show a sole structure for a shoe according to a third embodiment of the present invention. In these drawings, like reference numbers indicate identical or functionally similar elements in the first and second embodiments. In this third embodiment, the bottom wall surface 40 of the second midsole 4 is disposed at a region that corresponds to a thenar eminence TE (see FIG. 12) of the foot (or a ball of the foot) and its peripheral region. Also, other regions of the second midsole 4 have an opening 40*a* formed thereinto. Here, "thenar eminence" designates a first metatarsophalangeal joint (i.e. a metatarsophalangeal joint of a big toe) between a first proximal phalanx and a first metatarsal, and the peripheral bulges around the first metatarsophalangeal joint.

In this third embodiment, as with the first and second embodiments, when the second protrusions 30 of the outsole 3 come into contact with the ground at the time of ground contact, the ground surface information such as the size and direction of the ground reaction force acting from the ground to the second protrusions 30, and angularities of the ground surface or the like are transmitted to the first protrusions 20 of the first midsole 2 disposed at a position corresponding vertically to the second protrusions 30 of the outsole 3, and then transmitted to the foot sole of the shoe wearer from the first protrusions 20. Thereby, the ground surface information is feedbacked to the foot sole of the wearer.

In this case, since the bottom wall surface 40 of the second midsole 4 is disposed at the thenar eminence TE, the ground reaction force at the thenar eminence TE when landing onto the ground is transmitted from the second protrusions 30 of the outsole 3 through the bottom wall surface 40 of the second midsole 4 to the first protrusions 20 of the first midsole 2.

At this time, since the bottom wall surface 40 of the second midsole 4 has a lower compressive rigidity than the first midsole 2 and can thus absorb the ground reaction force, interposition of the bottom wall surface 40 can improve cushioning properties at the thenar eminence TE and relieve a thrust force locally exerted from the first protrusions 20 to the thenar eminence TE. Since the thenar eminence TE is a region that receives the highest foot pressure at the forefoot region F, the bottom wall surface 40 absorbs a load, such that thereby a large thrust force can be prevented from being locally imparted from the first protrusions 20 to the thenar eminence TE. Also, even in the case that the first protrusions 20 of the first midsole 2 at the thenar eminence TE are formed of a material having a high settling resistance, the bottom wall surface 40 of the second midsole 4 can improve cushioning properties at the thenar eminence TE. Thereby, the feedback of the ground surface information and the maintenance of cushioning properties can be achieved at the thenar eminence TE for a prolonged period of time.

On the other hand, the bottom wall surface 40 of the second midsole 4 is not provided at the rearfoot region and the forefoot region F other than the thenar eminence TE, but the opening 40*a* is disposed at such regions and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer. In this case, an impact load imparted to the rearfoot region at the time of impacting the ground can be absorbed by thickening a thickness of the first midsole 2 (see FIG. 15).

Fourth Embodiment

FIGS. 16 to 19 show a sole structure for a shoe according to a fourth embodiment of the present invention. In these drawings, like reference numbers indicate identical or functionally similar elements in the first to third embodiments. In this fourth embodiment, the bottom wall surface 40 of the second midsole 4 is disposed at a region that corresponds to a fifth metatarsal $MB_5$ of the foot and its peripheral region. Also, other regions of the second midsole 4 have an opening 40*a* formed thereinto.

In this fourth embodiment, as with the first to third embodiments, when the second protrusions 30 of the outsole 3 come into contact with the ground at the time of ground contact, the ground surface information such as the size and direction of the ground reaction force acting from the ground to the second protrusions 30, and angularities of the ground surface or the like are transmitted to the first protrusions 20 of the first midsole 2 disposed at a position corresponding vertically to the second protrusions 30 of the outsole 3, and then transmitted to the foot sole of the shoe wearer from the first protrusions 20. Thereby, the ground surface information is feedbacked to the foot sole of the wearer.

In this case, since the bottom wall surface 40 of the second midsole 4 is disposed at the fifth metatarsal $MB_5$, the ground reaction force at the fifth metatarsal $MB_5$ when landing onto the ground is transmitted from the second protrusions 30 of the outsole 3 through the bottom wall surface 40 of the second midsole 4 to the first protrusions 20 of the first midsole 2.

At this time, since the bottom wall surface 40 of the second midsole 4 has a lower compressive rigidity than the first midsole 2 and can thus absorb the ground reaction force, interposition of the bottom wall surface 40 can improve cushioning properties at the fifth metatarsal $MB_5$ and relieve a thrust force locally exerted from the first protrusions 20 to the fifth metatarsal $MB_5$. As a result, a fifth metatarsal fracture can be prevented during exercises. Also, even in the case that the first protrusions 20 of the first midsole 2 at the fifth metatarsal $MB_5$ are formed of a material having a high settling resistance, the bottom wall surface 40 of the second midsole 4 can improve cushioning properties at the fifth metatarsus metatarsal $MB_5$. Thereby, the feedback of the ground surface information and the maintenance of cushioning properties can be achieved at the fifth metatarsal $MB_5$ for a prolonged period of time.

On the other hand, the bottom wall surface 40 of the second midsole 4 is not provided but the opening 40*a* is disposed at the rearfoot region and the forefoot region F other than the fifth metatarsal $MB_5$ and its peripheral region, and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer. In this case, an impact load imparted to the heel region H at the time of impacting the ground is absorbed by thickening a thickness of the first midsole 2 (see FIG. 19).

Fifth Embodiment

FIGS. 20 to 23 show a sole structure for a shoe according to a fifth embodiment of the present invention. In these drawings, like reference numbers indicate identical or functionally similar elements in the first to fourth embodiments. This fifth embodiment is a variant of the above-mentioned third embodiment. In the third embodiment, the first midsole 2 extends from the heel region H through the midfoot region M to the forefoot region F, but in the fifth embodiment, the first midsole 2 is disposed only at the forefoot region F and a front end portion of the midfoot region M and is not disposed at the rearfoot region. In the fifth embodiment, there are no protrusions formed on the foot-sole-contact side of the heel region H and the remaining portion of the midfoot region M of the sole structure 1.

In this fifth embodiment, as with the first to fourth embodiments, when the second protrusions 30 of the outsole 3 come into contact with the ground at the time of ground contact, especially at the forefoot region F, the ground surface information such as the size and direction of the ground reaction force acting from the ground to the second protrusions 30, and angularities of the ground surface or the like are transmitted to the first protrusions 20 of the first midsole 2 disposed at a position corresponding vertically to the second protrusions 30 of the outsole 3, and then transmitted to the foot sole of the shoe wearer from the first protrusions 20. Thereby, the ground surface information is feedbacked to the foot sole of the wearer.

In this case, since the bottom wall surface 40 of the second midsole 4 is disposed at the thenar eminence TE, the ground reaction force at the thenar eminence TE when landing onto the ground is transmitted from the second protrusions 30 of the outsole 3 through the bottom wall surface 40 of the second midsole 4 to the first protrusions 20 of the first midsole 2.

At this time, since the bottom wall surface 40 of the second midsole 4 has a lower compressive rigidity than the first midsole 2 and can thus absorb the ground reaction force, interposition of the bottom wall surface 40 can improve cushioning properties at the thenar eminence TE and relieve a thrust force locally exerted from the first protrusions 20 to the thenar eminence TE. Also, even in the case that the first protrusions 20 of the first midsole 2 at the thenar eminence TE are formed of a material having a high settling resistance, the bottom wall surface 40 of the second midsole 4 can improve cushioning properties at the thenar eminence TE. Thereby, the feedback of the ground surface information and the maintenance of cushioning properties can be achieved at the thenar eminence TE for a prolonged period of time.

On the other hand, the bottom wall surface 40 of the second midsole 4 is not provided but the opening 40*a* is disposed at the forefoot region F other than the thenar eminence TE and its peripheral region, and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer. Also, an impact load imparted to the rearfoot region at the time of impacting the ground is absorbed by thickening a thickness of the first midsole 2 (see FIG. 23).

Sixth Embodiment

FIGS. 24 to 27 show a sole structure for a shoe according to a sixth embodiment of the present invention. In these drawings, like reference numbers indicate identical or functionally similar elements in the first to fifth embodiments. In the sixth embodiment, the bottom wall surface 40 of the second midsole 4 is disposed at the heel region H and a rear end portion of the midfoot region M, i.e. mainly at the heel region H, of the sole structure 1 and a thin hard plate 5 is provided at the midfoot region M and a rear end portion of the forefoot region F, i.e. mainly at the midfoot region M, of the sole structure 1. The hard plate 5 is formed of a hard elastic member, specifically, thermoplastic resin such as thermo-plastic polyurethane (TPU), polyamide elastomer (PAE), ethylene-vinyl acetate copolymer (EVA) and the like, or thermosetting resin such as epoxy and the like.

In this sixth embodiment, as with the first to fifth embodiments, when the second protrusions 30 of the outsole 3 come into contact with the ground at the time of ground contact, a ground surface information such as the size and direction of the ground reaction force acting from the ground to the second protrusions 30, and angularities of the ground surface or the like are transmitted to the first protrusions 20 of the first midsole 2 disposed at a position corresponding vertically to the second protrusions 30 of the outsole 3, and then transmitted to the foot sole of the shoe wearer from the first protrusions 20. Thereby, the ground surface information is feedbacked to the foot sole of the wearer.

In this case, since the bottom wall surface 40 of the second midsole 4 is disposed at the heel region H, the ground reaction force at the heel region H when landing onto the ground is transmitted from the second protrusions 30 of the outsole 3 through the bottom wall surface 40 of the second midsole 4 to the first protrusions 20 of the first midsole 2.

At this time, since the bottom wall surface 40 of the second midsole 4 has a lower compressive rigidity than the first midsole 2 and can thus absorb the ground reaction force, interposition of the bottom wall surface 40 can improve cushioning properties at the heel region H. A large impact load equivalent to a few times as large as a wearer's weight is imparted to the heel region at the time of impacting the ground. By absorbing such an impact load by means of the bottom wall surface 40, a large thrust force can be prevented from being locally exerted from the first protrusions 20 to the foot sole at the heel region H. Also, even in the case that the first protrusions 20 of the first midsole 2 at the heel region H are formed of a material having a high settling resistance, the bottom wall surface 40 of the second midsole 4 can improve cushioning properties at the heel region H. Thereby, the feedback of the ground surface information and the maintenance of cushioning properties can be achieved at the heel region H for a prolonged period of time.

On the other hand, at the forefoot region F, the bottom wall surface 40 of the second midsole 4 is not provided but the opening 40*a* is disposed, and the lower surface of the first midsole 2 is thus in direct contact with the upper surface of the outsole 3. Therefore, at the time of impacting the ground, the ground reaction force is directly transmitted from the second protrusions 30 of the outsole 3 to the first protrusions 20 of the first midsole 2 and the ground surface information is directly transmitted to the foot sole of the wearer. Also, bending rigidity of the midfoot region M is enhanced by providing the hard plate 5. Therefore, as a load during landing onto the ground is transferred from the heel region H through the midfoot region M to the forefoot region F, a downward deformation of the midfoot region M can be prevented thereby achieving a smooth load transfer.

Variant

In the above-mentioned first to fourth embodiments and sixth embodiment, from the heel region H to the forefoot region F, the first protrusions 20 of the first midsole 2 are disposed at the positions that correspond vertically to the second protrusions 30 of the outsole 3 respectively, and in the fifth embodiment, mainly at the forefoot region F, the first protrusions 20 of the first midsole 2 are disposed at the positions that correspond vertically to the second protrusions 30 of the outsole 3 respectively. However, an application of the present invention is not limited to such examples.

A region in which the respective first protrusions 20 correspond vertically to the respective second protrusions 30 may be only at the heel region H, only at the rearfoot region including the heel region H and the midfoot region M, alternatively, at a part of the heel region H or the rearfoot region. Collectively, it is described in the specification that at least a part of a plurality of first protrusions 20 of the first midsole 2 is located at a position corresponding vertically to at least a part of a plurality of second protrusions 30 of the outsole 3.

Other Application

In the above-mentioned embodiments and alternative embodiments, an example was shown in which the sole structure of the present invention was applied to the training shoe, but the application of the present invention is not limited to such an example. The present invention also has application to various sports shoes such as running shoes, walking shoes and the like, and alternatively, to shoes other than the sports shoes.

As mentioned above, the present invention is useful for a sole structure for a shoe that can secure cushioning properties and that can obtain a ground surface information.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

a first midsole that has a plurality of first protrusions on a foot-sole-contact side thereof;

an outsole that has a plurality of second protrusions on a ground surface side thereof; and a second midsole that is disposed at only a part of a region between said first midsole and said outsole, and that has a compressive rigidity lower than a compressive rigidity of said first midsole, wherein at least some of said first protrusions of said first midsole are located at respective positions corresponding vertically to at least some of said second protrusions of said outsole with said second midsole interposed therebetween, wherein said first midsole and said outsole are in indirect contact with each other via said second midsole at said part of said region between said first midsole and said outsole, wherein said first midsole and said outsole are in direct contact with each other at another part other than said part of said region between said first midsole and said outsole, and wherein said first protrusions of said first midsole at said another part correspond vertically to said second protrusions of said outsole.

2. The sole structure according to claim 1, wherein said first midsole extends from a heel region to a forefoot region of said sole structure, and said first protrusions are provided from said heel region to said forefoot region.

3. The sole structure according to claim 1, wherein said second midsole has a planar sheet portion at said part of said region between said first midsole and said outsole.

4. The sole structure according to claim 3, wherein said second midsole has an upraised portion that rises from a circumferential portion of said planar sheet portion and that extends encompassing a circumferential portion of said first midsole.

5. The sole structure according to claim 1, wherein said first midsole has a thin-plate-like base portion of a uniform thickness, and wherein said plurality of first protrusions are separated from each other and protrude from a base surface of said base portion.

6. The sole structure according to claim 5, wherein said plurality of first protrusions adjacent to each other on said base surface are divided by a plurality of grooves intersecting each other, and each one of said grooves has said base surface as a bottom surface thereof.

7. The sole structure according to claim 1, wherein said second midsole extends from a heel region to a midfoot region of said sole structure.

8. The sole structure according to claim 1, wherein said second midsole is disposed at a forefoot region of said sole structure.

9. The sole structure according to claim 1, wherein said second midsole is disposed at a region of said sole structure that corresponds to a distal portion of a first metatarsal of a foot of a person wearing a shoe having said sole structure.

10. The sole structure according to claim 1, wherein said second midsole is disposed at a region of said sole structure that corresponds to a fifth metatarsal of a foot of a person wearing a shoe having said sole structure.

11. The sole structure according to claim 1, wherein said first midsole and said outsole are disposed at a midfoot region of said sole structure, and wherein the sole structure further comprises a hard plate provided between said first midsole and said outsole at said midfoot region.

12. The sole structure according to claim 1, wherein at said part of said region between said first midsole and said outsole, said some of said first protrusions of said first midsole have a one-to-one vertical correspondence relation relative to said some of said second protrusions of said outsole through said second midsole.

* * * * *